United States Patent [19]

Adcock

[11] 4,163,478

[45] Aug. 7, 1979

[54] SELF ALIGNING IMPACT ROCK DRILLING TOOL

[76] Inventor: Gerald L. Adcock, 511 Airway Dr., Lewiston, Id. 83501

[21] Appl. No.: 942,605

[22] Filed: Sep. 15, 1978

[51] Int. Cl.[2] ..... E21B 7/04; E21B 17/10

[52] U.S. Cl. ..... 175/92; 175/325

[58] Field of Search ..... 175/92, 325, 408; 173/134

[56] References Cited

U.S. PATENT DOCUMENTS

| | | | |
|---|---|---|---|
| 2,589,534 | 3/1952 | Buttolph | 175/325 |
| 3,419,094 | 12/1968 | Bobo | 175/325 |
| 3,820,611 | 6/1974 | King | 175/92 |
| 3,999,618 | 12/1976 | Farris | 175/92 |

*Primary Examiner*—James A. Leppink

*Attorney, Agent, or Firm*—Wells, St. John & Roberts

[57] ABSTRACT

A downhole rock drilling tool is described that is adapted to mount an impact drilling bit at a lower end and to be operatively connected to a drilling rod or string at an upper end. The tool includes a free floating pneumatic piston. Valving is provided to control movement of the piston to repeatedly hammer against the drill bit to force the tool downwardly through earth and rock. The present tool is intended to be utilized with bits that produce a hole having a diameter at least 7.5 centimeters greater than the tool diameter. A pair of alignment rings are situated at upper and lower ends of the tool housing and extend radially outward to peripheral surfaces that lie directly adjacent to the hole wall. The rings are spaced longitudinally to maintain the tool in proper alignment with respect to the central axis of the drilled hole. The rings are also fluted longitudinally to enable relatively free passage of air and earth material upwardly through the hole during drilling operations.

5 Claims, 4 Drawing Figures

SELF ALIGNING IMPACT ROCK DRILLING TOOL

BACKGROUND OF THE INVENTION

The present invention is related to downhole, pneumatically operated, impact drilling tools and more particularly to such tools that are self-aligning within the drilled hole.

Pneumatic rock drilling tools have generally been limited to drilling holes having diameters slightly greater than the tool diameter. When drilled holes having diameters close to the diameter of the tool, the tool casing itself maintains the tool in substantial alignment with the hole axis. That is to say, the outside surfaces of the housing itself are spaced closely enough to the hole walls that substantial misalignment can not occur. It becomes difficult, however, to maintain tools in proper orientation relative to the hole axis when the hole diameter is more than 7.5 centimeters greater than the tool diameter. This problem has been overcome to a limited extent by increasing the thickness of the casing wall of the tool housing to substantially that of the drilled bore or hole diameter. This presents several other problems. Firstly, the tool weight is increased significantly and often results in excessive wear and damage to the associated bit. Another problem is that there is not sufficient clearance to enable air and earth material to escape freely upwardly from the operating drill bit. The peripheral housing of an elongated tool spaced closely adjacent to the hole walls is restrictive and does not allow free upward passage of any sizable earth material. Therefore the downward progress of the drill is hampered. A still further difficulty is in the manufacture of the tools themselves. The housing must be manufactured to the specification of the hole size to be drilled.

It therefore becomes desirable to obtain some form of self-aligning impact rock drilling tool that efficiently performs the function of maintaining the tool in proper central alignment with respect to the axis of the hole being bored and that does not add excessive weight to the tool housing nor impede downward progress of the tool by restricting upward passage of earth material and air. It is also desirable to obtain such a tool that may be manufactured with a housing of a standard size and with elements mounted to the standard size housing that are adapted to the purpose of alignment of the tool within a hole of specified diameter.

DETAILED DESCRIPTION OF A PREFERRED EMBODIMENT

Figure 4:
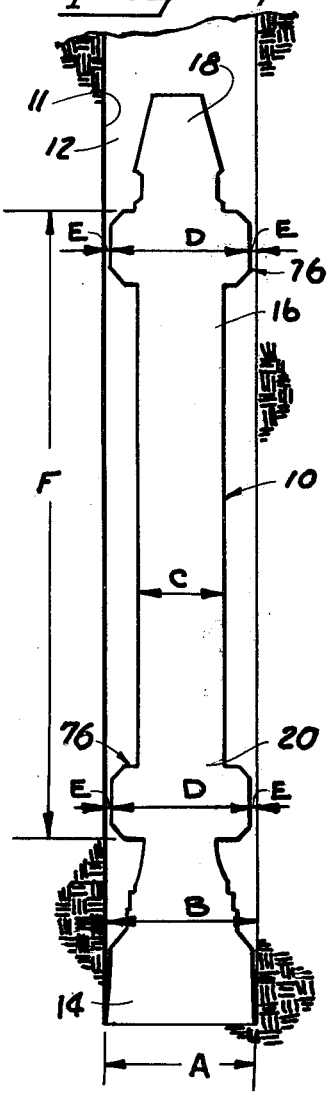
FIG. 4 is a diagrammatic view of the present invention shown in place within a drilled hole.

Referring now in detail to the drawings, there is illustrated a self-aligning impact rock drilling tool generally designated by the numeral 10. Drilling tool 10 operates to automatically align itself while being operated to form an open vertically oriented hole 11 (FIG. 4). The tool 10 is adapted to mount a large diameter bit 14 for penetrating an earth formation 12 as illustrated in FIG.

4. Such a large diameter drill bit is illustrated in U.S. Pat. No. 3,952,819 granted to Gerald L. Adcock on Apr. 27, 1976. The impact drilling tool 10 illustrated in FIG. 2 includes operational enclosed elements that are of a generally conventional design.

This invention is not limited to any particular type of interior structure for a downhole, pneumatically operated impact rock drilling tool. However, for purposes of understanding this invention it is desirable to be familiar with the major components of the tool 10 and its normal operation.

Tool 10 includes a cylindrical housing 16 that extends from an upper end or "back head" 18 to a lower end 20. The lower end 20 provides a drilling bit chuck 21 for receiving the large diameter drill bit 14. The upper end 18 has an air intake 19 (FIG. 2) for normally receiving pressurized air at a desired working pressure from an attached drill string (not shown) that is threadably received at the upper end 18. Thus, the tool is adapted to receive a drill bit 14 at its lower end 20 and a drill string at its upper end 18. The drill string is utilized to support the tool within the drilled hole and to supply pressurized air for operating its impact producing components.

Figure 1:
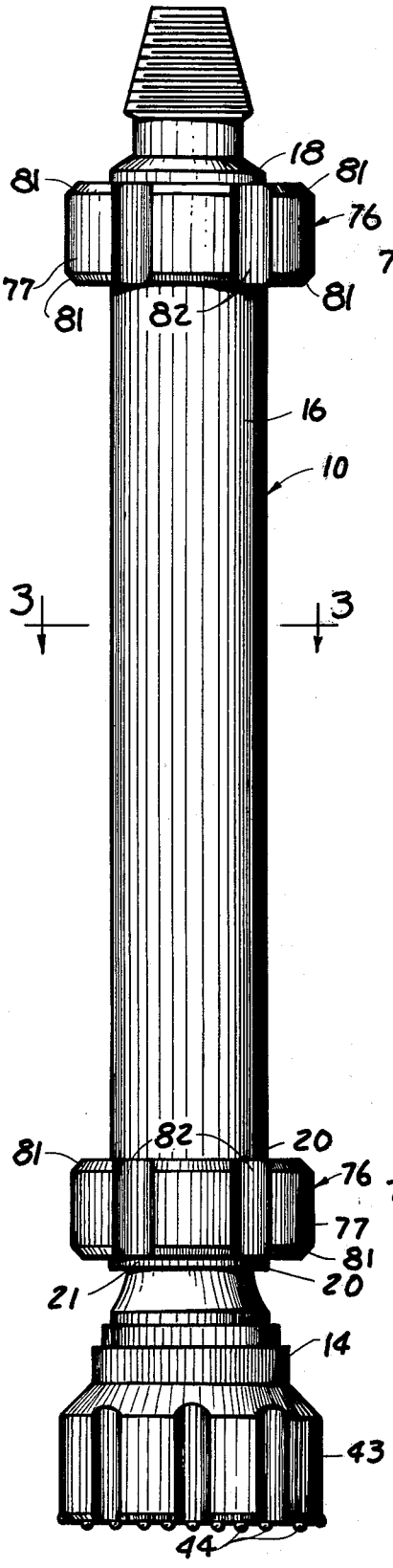
FIG. 1 is a vertical elevation view of the present invention shown mounting a drill bit.
Figure 2:
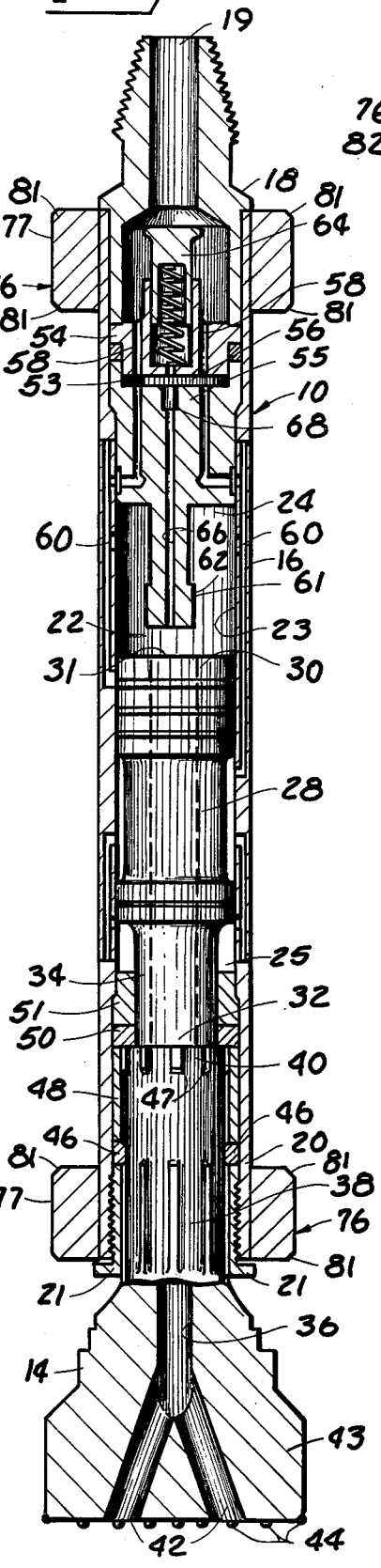
FIG. 2 is a vertical sectional view taken through the present tool.

The cylindrical housing 16 includes an enclosed internal cylindrical chamber 22 (FIG. 2). Chamber 22 includes a cylindrical wall 23 extending from an upper chamber end 24 to a lower chamber end 25.

Figure 3:
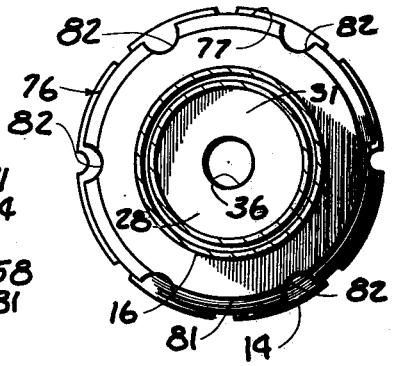
FIG. 3 is a sectional view taken along line 3—3 in FIG. 1.

An important feature of the drilling tool 12 is a freely movable hammer piston 28. The piston 28 is mounted within the cylindrical chamber 22 for free movement in a reciprocating motion from upper chamber end 24 to lower chamber end 25. The piston 28 is utilized to strike against the anvil end of the drill bit 14 at the lower chamber end 25 to transmit an impact pulse through the drilling bit to the bottom of the hole. The impact serves to fracture the earth formation and enable the tool to increase the depth of the hole. The hammer piston 28 includes an upper end 30 having a face surface 31. Piston 28 also includes the lower end 32 that is formed with a reduced stem 34 for striking the drill bit 14. The hammer piston 28 includes a central bore 36 (FIG. 3) extending to the drill bit 14 for discharging air through the drilling tool to the drill bit 14.

The drill bit 14 has an elongated body 38 with an upper anvil portion 40 and an enlarged lower bit portion 43. Splines 41 are formed on the side of the elongated body for complementary engagement with the chuck 21 to cause the bit 14 to rotate with rotation of the tool 10. Air passages 42 are formed through the elongated body 38 in open communication with the central bore 36. They enable air to pass through the bit 14 to flush earth particles from the bottom of the hole upward alongside the tool.

The enlarged bit portion 43 has carbide buttons or cutters 44 formed or attached thereto for cutting the earth formation. These buttons or cutters 44 define an outside diameter of the bit that is designated in FIG. 4 by the reference character A. The buttons form the overall diameter of the finished or drilled hole. This dimension is indicated in FIG. 4 by the reference character B. The diameters A and B are nearly identical and will vary an insignificant amount due to moisture content of the earth material surrounding the bit and termperature variations. An example of a large diameter drill is illustrated in U.S. Pat. No. 3,952,819.

The check 21 includes a retaining ring 46 for securing the drill bit 14 therein and for enabling the bit 14 to move in a limited reciprocal fashion from a closed working condition illustrated in FIG. 2 to an extended nonworking position in which flanges 47 on the drill bit end 40 engage the retaining ring 46. The chuck 21 includes a spacer 48 that extends along the elongated body 38 for supporting a bearing washer 50 and piston bearing assembly 51. The piston bearing 51 slidably supports the reduced stem 34 of piston 28.

As briefly discussed above, the tool 10 is adapted to receive pressurized air from an above ground source through the string line at a working pressure through its intake 19. Air flow is controlled by means of valving adapted to force the piston 28 to repeatedly strike the drill bit. A main air feed valve 53 is formed by a valve chest 54 and a valve seat 55. The valve 53 includes a valve disk 56 formed therein for permitting air flow from the air intake 19 through the main air passages 58 to the cylindrical chamber 22. Main air passageways 58 include ports 60 that are formed in the cylindrical wall 23 for emitting air into the internal cylindrical chamber 22. These ports 60 are adjacent the upper end of chamber 22.

Tool 10 further includes an exhaust valve 61 that includes a valve guide 62 extending from the valve seat 55 downwardly into the cylindrical chamber 22. The valve guide 62 is complementary to the central bore 36 formed through the piston 28. Thus, the piston 28 will move upwardly and over the valve guide 62 to prevent air from passing from the chamber 22 through the central bore 36. When the piston is driven downwardly, the upper end 30 eventually uncovers the valve guide 62 and enables air within the chamber 22 to exhaust through the central bore 36.

The tool 12 further includes a check valve 64 to close the intake 19 should pressure within the tool exceed the working pressure from the drill string. Additionally, the tool includes a bleed passageway 66 that extends from the intake through the valve seat and disk valve 56 for bleeding purging air into the central bore 36 to maintain sufficient pressure within the tool to prevent water, mud or dirt from passing into the tool through the air passage 42 in the drill bit 14. A choke valve 68 is formed in the bleed passageway 66 to limit the amount of air that may be bled from the intake through the bleed passageway 66.

The housing 16 has an outside diameter as shown at C in FIG. 4. In one example the tool diameter is approximately 22.23 cm. When the intended hole diameter is less than 30 cm., the housing itself will aid to maintain the tool in alignment with the axis of the hole as the tool is moved progressively downward. However, the 22.23 cm. diameter tool may also be utilized in combination with a larger size bit 14 for producing a hole of a diameter up to 50.8 cm. In holes of diameters 7.5 cm. greater than the tool diameter (7.5 cm. +C), the exterior surface of the housing becomes ineffective as an alignment mechanism for the drill due to the substantial difference between the hole diameter and tool diameter. Consequently the resulting hole may be out of "plumb" or its axis may not fall along a relatively straight line. Therefore, I have provided longitudinally spaced alignment rings 76 for the purpose of maintaining alignment of the tool and bit along the hole axis during the entire drilling process.

A single alignment ring 76 is mounted at the upper end 18 of housing 16 and another similar ring 76 is mounted at the lower end 20. The rings 76 are not integral with the housing but, instead, are rigidly affixed to the housing during assembly. It is preferred that the alignment rings be attached to the housing by an interference fit such as an expansion or heat seize force fit to enable the same diameter housing 16 to be utilized with different diameter alignment rings. Therefore, the same identical internal components as described above may be utilized within identical sized housing but with varying size alignment rings.

Each alignment ring 76 includes an exterior peripheral surface 77. This surface 77 defines a diameter D that is slightly less than the hole diameter B and substantially greater than the diameter of the housing C. The difference between diameter D and B is indicated by the spaces in FIG. 4 labeled E. Further, the longitudinal spacing between the alignment rings 76 is indicated in FIG. 4 by the reference character F. It is preferred that the diameter D of the alignment rings be such that the spaces E are less than 0.5 cm. This spacing, coupled with the longitudinal spacing of the rings (F) is such that the housing and attached bit will remain coaxial with the hole axis. Actually the longitudinal spacing F between the aligning rings 76 is at least twice the hole diameter. When the peripheral surfaces 77 engage the hole walls, the drill will seek a path of less resistance and center itself along the upright hole axis.

The alignment rings 76 include upper and lower beveled edges 81 that are provided to facilitate raising and lowering of the tool within the drilled hole without interference or gouging against the drilled walls. Also, longitudinal flutes 82 are provided. The flutes 82 are formed in the exterior peripheral surface 77 and lead vertically between the edges 81. The flutes 82 are of sufficient size to enable free upward passage of air and earth material produced through operation of the drill bit. This, coupled with the difference between the tool diameter C and hole diameter B, enables relatively free upward passage of debris or drilling waste that has heretofor been impossible with close tolerance enlarged housing diameter tools.

It should be understood that the above described embodiment is simply illustrative of the features of this invention and that other embodiments may be devised without deviating therefrom. Therefore, only the following claims are intended to define this invention.

What I claim is:

1. A self aligning downhole impact rock drilling tool adapted to receive a drill bit for forming a hole having a diameter of more than 7.5 cm. than the diameter of the tool, comprising:

an elongated cylindrical tool housing extending between an upper end and a lower end and having an outside diameter defining the tool diameter;

an internal pneumatic chamber within the housing;

a chuck at the lower end of the tool housing adapted to receive and securely mount a drill bit having an outside working diameter greater than 7.5 cm. of the diameter of the elongated tool housing and substantially equal to the hole diameter;

said upper end being adapted to operatively connect to an end of a drill string to receive pressurized air therefrom;

a piston within the pneumatic chamber adapted to strike the drill bit;

valve means within the housing for receiving and directing pressurized air and adapted to force the piston to repeatedly strike the drill bit;

a pair of longitudinally spaced alignment rings on the cylindrical housing, each having an exterior peripheral surface spaced radially outward of the cylindrical housing and having a diameter slightly less than the diameter of a drilled hole and at least 7.5 cm. greater than the diameter of the cylindrical housing;

wherein each alignment ring is affixed by an interference fit to the housing with one ring at the upper housing end and the remaining ring spaced longitudinally from the one ring at the lower housing end to cooperate to maintain a coaxial relationship between the cylindrical tool and drilled hole by sliding engagement along the hole wall; and wherein the alignment rings include upright flutes along the peripheral surfaces thereof to permit air and earth material to pass upward between the hole walls and alignment rings.

2. The self aligning impact rock drilling tool as defined by claim 1 wherein the diameters of each aligning ring is 0.3175 cm. less than the diameter of the drilled hole.

3. The self aligning impact rock drilling tool as defined by claim 1 where the longitudinal spacing between the aligning rings is at least twice the hole diameter.

4. The self aligning impact rock drilling tool as defined by claim 1 wherein each aligning ring includes beveled upper and lower edges leading inwardly from the peripheral surface.

5. The self aligning impact rock drilling tool as defined by claim 1 wherein the rings are heat seized on the cylindrical housing to form the interference fit.

* * * * *